United States Patent [19]

Noguchi et al.

[11] 4,381,990

[45] May 3, 1983

[54] PROCESS FOR PRODUCING MESOCARBON MICROBEADS OF UNIFORM PARTICLE-SIZE DISTRIBUTION

[75] Inventors: Kosaku Noguchi, Tokyo; Honami Tanaka, Izumi; Yukimasa Kumura, Izumi; Eiji Kitajima, Izumi; Noriyuki Tsuchiya, Izumi; Tomonori Sunada, Ootsu, all of Japan

[73] Assignee: Koa Oil Company, Limited, Tokyo, Japan

[21] Appl. No.: 316,904

[22] Filed: Oct. 30, 1981

[30] Foreign Application Priority Data

Nov. 5, 1980 [JP] Japan ..... 55-154653

[51] Int. Cl.[3] ..... C10C 3/08; C10C 1/00; C10C 3/00; C10B 57/14

[52] U.S. Cl. ..... 208/39; 208/45; 423/445; 423/449

[58] Field of Search ..... 208/39, 45; 423/445, 423/449

[56] References Cited

U.S. PATENT DOCUMENTS

| | | | |
|---|---|---|---|
| 2,896,261 | 7/1959 | McAfee | 208/39 |
| 4,080,283 | 3/1978 | Noguchi et al. | 208/40 |
| 4,303,631 | 12/1981 | Lewis et al. | 208/39 |

FOREIGN PATENT DOCUMENTS

| | | | |
|---|---|---|---|
| 50-157295 | 12/1975 | Japan | 423/445 |
| 699470 | 11/1953 | United Kingdom | 423/449 |
| 2028368 | 3/1980 | United Kingdom | 423/445 |
| 2067538 | 7/1981 | United Kingdom | 423/445 |

OTHER PUBLICATIONS

Chem. Abstracts, vol. 67, 1967, 13666e, Carbon Microspheres, Charbonnages de France, Fr. 1458195 11-1-0-66.

*Primary Examiner*—Delbert E. Gantz
*Assistant Examiner*—Helane E. Maull
*Attorney, Agent, or Firm*—Wenderoth, Lind & Ponack

[57] ABSTRACT

Mesocarbon microbeads of narrow particle-size distribution are produced by: subjecting a heavy oil to a primary heat treatment at a temperature $T_1$ to prepare a pitch containing mesophase microspheres; once cooling this pitch to a temperature lower than its softening point; thereafter subjecting the pitch to a secondary heat treatment at a temperature $T_2$, which is higher than 350° C. and lower than ($T_1-40°$ C.); cooling the pitch at a cool rate lower than 200° C./hour; separating from the pitch mesophase microspheres which precipitated in the secondary heat-treatment step; and thereafter obtaining by solvent extraction mesophase microspheres of substantially uniform particle size formed in the residual pitch. The mesocarbon beads of narrow particle-size distribution thus obtained are particularly suitable for use as chromatograph packing material, catalyst support, and other uses.

6 Claims, 9 Drawing Figures

PROCESS FOR PRODUCING MESOCARBON MICROBEADS OF UNIFORM PARTICLE-SIZE DISTRIBUTION

BACKGROUND OF THE INVENTION

This invention relates to a process for producing mesocarbon microbeads of uniform particle size distribution by using as a starting material a heavy oil, that is, a heavy hydrocarbon oil originated from petroleum, coal, oil sand, oil shale or the like.

It is known in the prior art that mesocarbon microbeads (hereinafter referred to by the abbreviation "MC") can be obtained by heat treating a heavy oil at a temperature of 350° to 500° C. to obtain a heat-treated pitch and separating optically anisotropic microspheres (mesophase microspheres) formed within the pitch from the pitch matrix by solvent extraction. MC obtained in this manner are carbon precursors of spherical shapes close to perfect spheres of diameters of 1 to 100 microns and are constituted by condensed polycyclic aromatics in laminated alignment in a specific direction. Because of their unique form and crystalline structure, these MC have high electrical, magnetic, and chemical activities, and extensive utilization thereof in various diversified fields is expected.

More specifically, there are great expectations for the utilization of these MC for production of various industrial materials, examples of which are: special carbon materials such as high-density isotropic carbon materials and electrical resistance carbons prepared by carbonization after molding thereof; composite materials such as electroconductive ceramics, dispersion-reinforced metals, and electroconductive plastics prepared by carbonizing the MC as they are and thereafter blending the resulting material with other materials; and chemical materials such as catalyst supports and packing material for chromatography prepared by forming the MC into particles as they are or after carbonization.

For certain applications such as those for chromatography packing material and catalyst support among the above enumerated utilizations, the particle size of the MC is required to uniformly conform to specific sizes. However, the particle size of MC produced by a process depending on ordinary heat treatment of a heavy oil is distributed over a broad range (which may be as broad as 1 to 100 microns in most cases). Accordingly, the production of MC of narrow particle-size distribution by some method is desired in many fields. For fulfilling this need, some methods as described below are thought of or have been proposed.

(a) A method wherein a portion of specific particle sizes is separated out by sieving or by mechanical dispersion from MC produced by an ordinary process.

(b) A method wherein, by blowing superheated steam into a heavy oil thereby to agitate and heat the oil, thereby carrying out uniform heat treatment of the heavy oil, MC of narrow particle-size distribution are obtained (Japanese Pat. Publn. No.9599/1978).

(c) A method wherein the growth of the mesophase microspheres is suppressed by using one or more additives (as disclosed, for example, in "Tanso" ("Carbon"), No.77, P.61 (1974)).

However, none of these methods can be said to be completely satisfactory. More specifically, for example, it is difficult in the above method (a) to classify efficiently on an industrial scale the MC which are microspheres of micron size. In the methods (b) and (c), it becomes difficult to obtain MC of perfect spherical shape, and the effectiveness in uniformization of the particle size is still inadequate.

SUMMARY OF THE INVENTION

In view of the above described state of the known methods, it is an object of this invention to provide a new process for producing MC of narrow particle-size distribution.

As a result of intense research carried out, with the above object, with respect to the mechanism of formation and growth of mesophase microspheres in heat treatment of heavy oil or pitch, we have made the following discoveries. The first is that, when pitch containing mesophase microspheres obtained by heating treatment of a heavy oil is subjected to the steps of once cooling, reheating, and recooling, a remarkable uniformizing of the MC particle size is attained. The second discovery is that, by controlling the rate of the final cooling, it is possible to regulate the particle size of the MC. The process of producing MC of narrow particle-size distribution of this invention is based on and has been developed from these findings.

According to this invention, briefly summarized, there is provided a process for producing mesocarbon microbeads of narrow particle-size distribution which comprises: preparing a primary heat-treated pitch containing mesophase microspheres by subjecting a heavy oil to a primary heat treatment; once cooling the pitch thus prepared to a temperature equal to or lower than the softening point thereof; thereafter subjecting the pitch to a secondary heat treatment at a temperature which is equal to or higher than 300° C. and, moreover, is equal to or lower than the temperature which is 20° C. lower than the primary heat-treatment temperature; cooling the pitch at a cooling rate equal to or lower than 200° C./hour; separating, from the pitch thus heat treated, mesophase microspheres which precipitated in the secondary heat-treatment step; and thereafter obtaining by solvent extraction mesophase microspheres of substantially uniform particle size formed in the residual pitch.

The nature, utility, and further features of this invention will be more clearly apparent from the following detailed description, beginning with a consideration of general and fundamental aspects of the invention and concluding with a specific example of practice illustrating a preferred embodiment thereof and comparison examples, when read in conjunction with the accompanying illustrations comprising drawings and photomicrographs as briefly described below.

ILLUSTRATIONS

In the illustrations:

FIGS. 1(*a*), 1(*b*) and 1(*c*) are schematic side elevations for an explanation of why and how MC of narrow particle-size distribution are obtained by the process of this invention;

FIGS. 2(*a*) and 4(*a*) are photomicrographs (magnification 172X), taken with a polarizing microscope, respectively of primary heat-treated pitch and secondary heat-treated pitch;

FIGS. 2(*b*) and 4(*b*) are photomicrographs, taken with a scanning electron microscope, respectively of MC obtained by quinoline extraction from primary heat-treated pitch and secondary heat-treated pitch;

FIGS. 3 and 5 are graphs respectively indicating the particle-size distributions of MC obtained by quinoline extraction from primary heat-treated pitch and secondary heat-treated pitch; and FIGS. 6 and 7 are photomicrographs (magnification 172X), taken with a polarizing microscope, respectively of primary heat-treated pitch corresponding to FIG. 2(*a*).

DETAILED DESCRIPTION

The reason why uniformization of particle size is attainable by the process of this invention is not fully clear, but it may be considered to be as follows.

Figure 1:
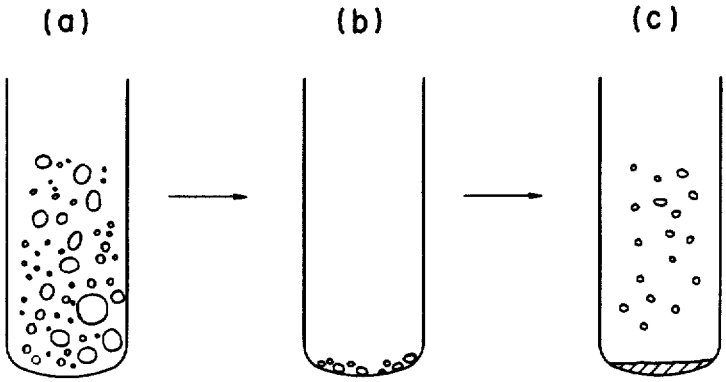

In a pitch in a state wherein it has been subjected to a primary heat treatment and then once cooled, mesophase microspheres of diverse sizes as indicated in FIG. 1(*a*) are dispersed, similarly as in pitch which has been heat treated by an ordinary process as described hereinbefore. When this pitch is reheated, of the mesophase microspheres, those of high solubility (considered to be principally those formed in the cooling step after the primary heat treatment) are dissolved again, while those of low solubility (considered to be principally those of high degree of heat treatment formed in the heating step) do not dissolve but settle on the bottom of the vessel as indicated in FIG. 1(*b*). When the pitch after reheating is cooled, the mesophase component which has dissolved is again separated out as microspheres of uniform particle size determined by the rate of cooling, as indicated in FIG. 1(*c*).

The mesophase microspheres which are insoluble and have settled on the bottom accumulate, as they are, on the bottom while coalescing during the above described steps. Accordingly, by separating the upper phase and the lower phase, e.g., by decantation at a stage where the matrix pitch retains its liquid form in the state of FIG. 1(*b*) or 1(*c*), for example, at a temperature of the order of approximately 200° C., mesophase microspheres of uniform particle size are obtained in the cooled substances of the upper phase. Then, by subjecting these mesophase microspheres to solvent extraction, MC of uniform particle size are obtained.

In the process of this invention, firstly, a heavy oil such as atmospheric-pressure residue oil, reduced-pressure residue oil, decant oil from the catalytic cracking, thermal cracking tar, or coal tar is heated at 350° to 500° C. and thus subjected to a primary heat treatment. While specific temperature and times of this primary heat treatment differ with the kind of the starting material heavy oils (inclusive of materials ordinarily called pitches), it is preferable to so select these conditions that the quantity of the quinoline insoluble component (i.e., mesophase) of the pitch after the primary heat treatment will be 5 to 15 percent by weight.

Then, the pitch after the primary heat treatment is once cooled to a temperature equal to or below the softening point thereof. The lower limit of the cooling temperature is not critical and may be room temperature. However, unless the cooling is carried out to a temperature equal to or below the softening point, the separation by settling described above with reference to FIGS. 1(*b*) and 1(*c*) will not occur to an ample degree. The reason for this may be considered to be contributive effects such as an increase due to the cooling in the difference between the specific gravities of the mesophase and the matrix pitch and the removal due to the cooling of $\beta$-resin existing on the surface of the mesophase at a high temperature and contributing to the formation of micell structure between the mesophase and the matrix pitch. The cooling rate is not particularly critical and may be any value below 400° C./hour, for example.

The pitch thus cooled is further subjected to a secondary heat treatment at a temperature which is equal to or higher than 300° C. and is equal to or lower than the temperature resulting as a difference when 20° C. is subtracted from the primary heat-treatment temperature.

We have found that when this secondary heat-treatment temperature is less than 300° C., the particle size of the MC becomes ununiform. The reason for this may be considered to be as follows. The secondary heat treatment has the function of again dissolving in the matrix pitch the mesophase microspheres formed in the primary heat treatment and the function of causing the mesophase microspheres which do not dissolve to settle onto the bottom of the vessel thereby to be separated. At a low temperature, however, the solubility does not become sufficiently great, and, also, the viscosity of the matrix pitch does not decrease to a degree sufficient to give rise to settling.

We have found further that, when the secondary heat-treatment temperature is higher than the upper limit of the primary heat-treatment temperature minus 20° C., also, the particle size of the MC becomes ununiform. The reason for this may be considered to be that, in the case where the secondary heat treatment is carried out at a high temperature, the result is not merely the dissolving again of the mesophase microspheres formed in the primary heat treatment but is also the formation of new mesophase microspheres. Therefore, it is necessary to carry out the secondary heat treatment at a temperature at which the matrix pitch will not, essentially, give rise to an additional thermal cracking and thermal condensation reaction. Since the upper limit temperature differs with the chemical properties and history of the pitch, the determination of the upper limit temperature on the basis of the primary heat-treatment temperature as described above is suitable.

More preferably, the secondary heat-treatment temperature is a temperature equal to or higher than 350° C. and equal to or lower than the temperature which is 40° C. lower than the primary heat-treatment temperature. The time duration of the secondary heat treatment is not particularly critical. That is, the lower limit is a time in which uniformization of the MC particle size can be achieved, while the upper limit is a time in which new mesophase is not excessively formed. On the basis of actual results, however, the lower limit may be of an order such that cooling is started immediately after the secondary heat-treatment temperature has been reached. While the upper limit depends also on the secondary heat-treatment temperature among other factors, it may be of the order of 120 minutes. However, the secondary heat-treatment time is preferably as short as possible as long as the separation of the insoluble mesophase by uniform settling can be achieved. The rate of temperature rise to the secondary heat-treatment temperature also is not very critical, but a practical rate is of the order of 1° to 20° C./minute.

The pitch after the secondary heat treatment is cooled at a cooling rate equal to or lower than 200° C./hour. We have found that when this cooling rate exceeds 200° C./hour, the particle size of the MC obtained is excessively small. Even when this cooling rate is equal to or below 200° C./hour, the particle size of the MC is influenced by the cooling rate used. More specifically, a high cooling rate results in a small MC particle size, while a low cooling rate results in a large MC particle size. The reason for this is that the crystalline growth rate has an influencing effect on the particle size. Accordingly, it is necessary to select the cooling rate in accordance with the purpose of utilization of the MC. By thus selecting the cooling rate, it is possible to regulate the MC particle size to any desired size within a range of 1 to 30 microns.

In practicing the process of this invention, it is necessary to carry out the secondary heat treatment and the succeeding cooling step with substantially no agitation. For the primary heat treatment, the continuous pitch producing apparatus of multiple vessel type described in the specification of U.S. Pat. No. 4,080,283 (incorporated herein by reference), for example, can be used.

The mesophase which has settled and coalesced or bulked in the secondary heat-treatment step as described hereinabove, is thereafter separated, for example, by decantation or tapping from the bottom of the vessel, from the pitch in which mesophase microspheres of uniform particle size are dissolved or dispersed, at any time at which the pitch retains its liquid form, at a temperature of approximately 200° C., for example. The mesophase material thus separated and removed can, of course, be utilized as a starting material for forming carbon materials and the like.

On the other hand, the pitch containing mesophase microspheres of uniform particle size after the secondary heat treatment are mixed, while being heated according to necessity, with an aromatic solvent of, for example, quinoline, pyridine, anthracene oil, or the like, and the matrix pitch is selectively dissolved thereby to obtain mesophase microspheres as MC by solid-liquid separation. In the instant specification, the series of these process steps is referred to as "solvent extraction".

While the solid-liquid separation can, of course, be accomplished also by means of a screen sieve or a filter, the use of liquid cyclones is preferable for industrial production. Preferably, the obtaining of the MC from the pitch in this manner is carried out by a process involving the use of the multistage liquid cyclones of the copending U.S. patent application Ser. No. 222,901 (incorporated herein by reference). The after-stage liquid cyclones are used for washing MC and imparting a further classification effect, and the use therein of a non-aromatic solvent is also possible.

According to this invention as described above, by once cooling a pitch containing mesophase microspheres obtained by heat treatment of a heavy oil, thereafter reheating the pitch, and then further cooling the pitch at a specific cooling rate, MC having a very narrow particle-size distribution and, moreover, a particle size regulated by control of the cooling rate are obtained, these MC being suitable for use as chromatograph filler material, catalyst support, etc.

In order to indicate more fully the nature and utility of this invention, the following specific example of practice thereof and comparison examples are set forth, it being understood that these examples are presented as illustrative only and are not intended to limit the scope of the invention.

Comparison Example 1

Figure 2A:
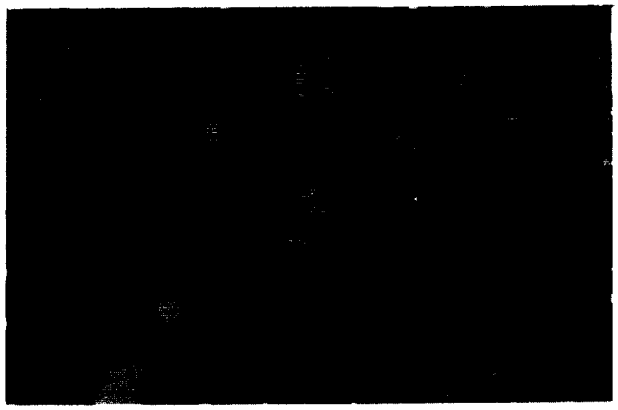
Figure 2B:
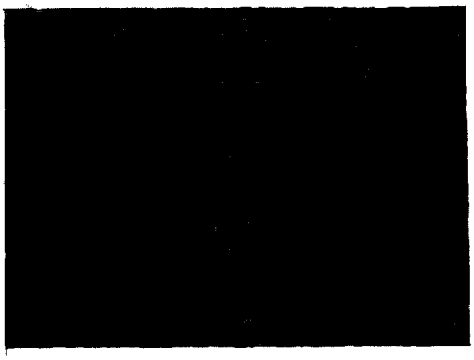

Decant oil (boiling point range 440° C. and higher) obtained by thermal cracking of petroleum was heat treated at 450° C. for 75 minutes and then cooled at a rate of approximately 400° C./hour thereby to prepare a primary heat-treated pitch. A photomicrograph (magnification of 172X) taken through a polarizing microscope of this pitch is shown in FIG. 2(*a*). It is observable in this figure that a large number of mesophase microspheres have been formed in the pitch, but these microspheres are of various particle sizes.

Figure 3:
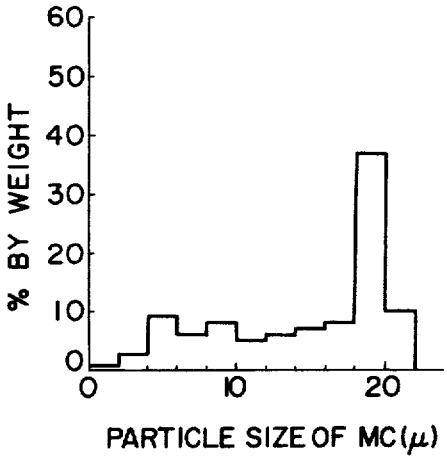

The above described pitch was mixed with 15 times its quantity of quinoline, and the matrix pitch was dissolved thereby to separate out MC in a yield of 5.4 percent by weight (based on the pitch). A photomicrograph (magnification of 1,000X) taken through a scanning electron microscope of the MC thus obtained is shown in FIG. 2(*b*), and the particle-size distribution thereof is indicated in FIG. 3. As is apparent from FIG. 3, the particle size of the MC is distributed over a wide range of approximately 1 micron to 20 microns or more.

Example 1

The primary heat-treated pitch obtained in Comparison Example 1 was reheated to 380° C. at a temperature rise rate of 3° C./minute and was then immediately cooled at a cooling rate of 60° C./hour. Then, when the temperature reached 200° C., the supernatant part of the pitch was taken out by decantation. At this time, a sediment was left as residue on the bottom. The supernatant part of the pitch was further cooled at the rate of 60° C./hour.

Figure 5:
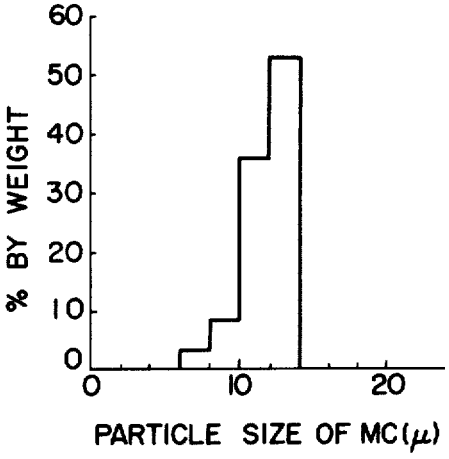
Figure 4A:
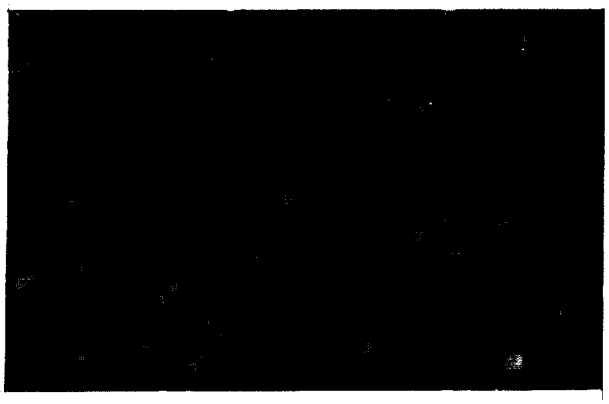
Figure 4B:
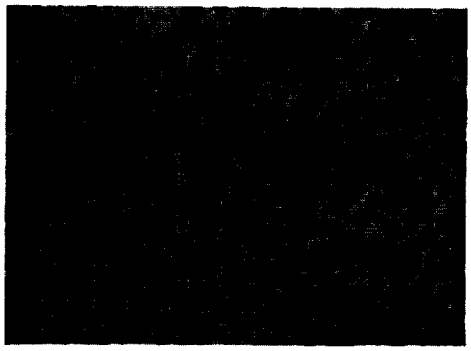

A photomicrograph (magnification of 172X) taken through a polarizing microscope of the pitch thus obtained is shown in FIG. 4(*a*). This pitch was subjected to quinoline extraction similarly as in Comparison Example 1 thereby to obtain MC. A photomicrograph taken through a scanning electron microscope of the MC thus obtained is shown in FIG. 4(*b*), and its particle-size distribution is indicated in FIG. 5.

It is observable from FIGS. 4(*b*) and 5 that the particle-size distribution of the MC thus obtained is in a range of approximately 10 to 14 microns, and that MC of remarkably improved particle-size distribution were obtained by the process of this invention.

The yield based on the pitch of the MC thus obtained was 3.6 percent by weight. That is, by comparison with Comparison Example 1, of the MC of 5.4 percent by weight formed in the primary heat treatment, 66.7 percent thereof was converted through the secondary heat treatment into MC of uniform particle size, while the remaining 33.3 percent precipitated without being dissolved again. In contrast, as will be apparent from FIG. 3 corresponding to Comparison Example 1, of the MC formed in Comparison Example 1, the portion having particle sizes of 10 to 14 microns is only 11 percent.

Thus, the secondary heat treatment has not only the effectiveness of merely selecting a portion of a specific particle-size range from the MC formed in the primary heat treatment but also the astonishing effectiveness of recreating a desired particle size distribution.

Comparison Example 2

Figure 6:
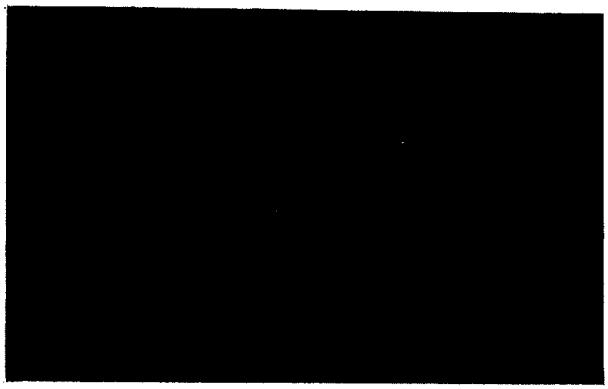

The same starting material as that of Comparison Example 1 was treated under the same conditions as those of the secondary heat treatment of Example 1, that is, heating to 380° C. at a temperature rise rate of 3° C./minute and cooling immediately thereafter to room temperature at a cooling rate of 60° C./hour, thereby to obtain a primary heat-treated pitch. A photomicrograph taken through a polarizing microscope of this pitch is shown in FIG. 6, from which it is apparent that no mesophase microspheres were formed.

Therefore, it is evident that the MC of uniform particle size obtained in Example 1 were not formed newly by the secondary heat treatment but were MC resulting from the mesophase microspheres formed in the primary heat treatment which were uniformized by being dissolved again in the pitch matrix in the secondary heat treatment and then reprecipitated.

Comparison Example 3

The same starting material as that of Comparison Example 1 was heat treated at 450° C. for 75 minutes and thereafter gradually cooled at a cooling rate of 60° C./hour to room temperature thereby to prepare a primary heat-treated pitch.

Figure 7:
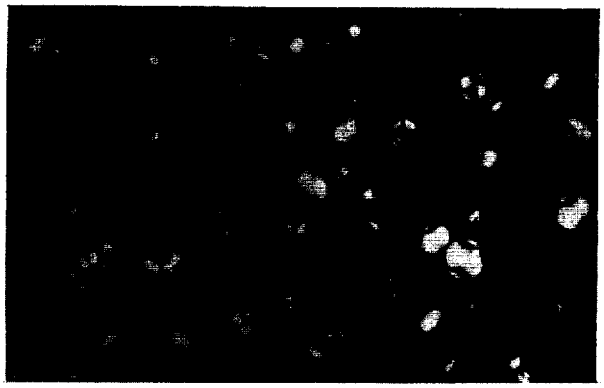

A photomicrograph taken through a polarizing microscope of this pitch is shown in FIG. 7. The mesophase microspheres formed in this case did not include any very small microspheres in contrast to those of Comparison Example 1 but were not of uniform particle size. Thus, it is obvious that mere slow cooling in the cooling step is insufficient for uniformization of the particle size of the mesophase microspheres, and carrying out of a secondary heat treatment is necessary.

What is claimed is:

1. A process for producing mesocarbon microbeads of narrow particle-size distribution which comprises: preparing a primary heat-treated pitch containing mesophase microspheres by subjecting a heavy oil to a primary heat treatment; once cooling the pitch thus prepared to a temperature equal to or lower than the softening point thereof; thereafter subjecting the pitch to a secondary heat treatment at a temperature which is equal to or higher than 300° C. and, moreover, is equal to or lower than the temperature which is 20° C. lower than the primary heat-treatment temperature; cooling the pitch at a cooling rate equal to or lower than 200° C./hour; separating, from the pitch thus heat treated, mesophase microspheres which precipitated in the secondary heat-treatment step; and thereafter obtaining by solvent extraction mesophase microspheres of substantially uniform particle size formed in the residual pitch.

2. A process according to claim 1 in which the secondary heat-treatment temperature is equal to or higher than 350° C. and, moreover, is equal to or lower than the temperature which is 40° C. lower than the primary heat-treatment temperature.

3. A process according to claim 1 in which, by controlling the cooling rate after the secondary heat-treatment step, the particle size of the mesocarbon microbeads obtained is regulated to a desired value within the range of 1 to 30 microns.

4. A process according to any of claims 1, 2 and 3 in which the separation of the precipitated mesophase microspheres is carried out by decantation of the secondary heat-treated pitch.

5. A process according to claim 1 in which the secondary heat-treated pitch after separation of the precipitated mesophase is diluted with an aromatic solvent, and, by solid-liquid separation, mesophase microspheres of substantially uniform particle size are obtained.

6. A process according to claim 5 in which the solid-liquid separation is carried out by means of multiple stages of liquid cyclones.

* * * * *